US012503201B2

(12) United States Patent
Withers et al.

(10) Patent No.: US 12,503,201 B2
(45) Date of Patent: Dec. 23, 2025

(54) REMOTE ACTUATED TENT POLE

(71) Applicant: Taylor Made Group, LLC, Gloversville, NY (US)

(72) Inventors: Charles Robert Withers, Parrish, FL (US); Robert R. Shearer, Bradenton, FL (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 619 days.

(21) Appl. No.: 17/954,733

(22) Filed: Sep. 28, 2022

(65) Prior Publication Data

US 2023/0094367 A1 Mar. 30, 2023

Related U.S. Application Data

(60) Provisional application No. 63/249,184, filed on Sep. 28, 2021.

(51) Int. Cl.
*B63B 17/00* (2006.01)
*B63B 17/02* (2006.01)

(52) U.S. Cl.
CPC ..... *B63B 17/00* (2013.01); *B63B 17/02* (2013.01); *B63B 2017/0045* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | | |
|---|---|---|---|---|
| 5,479,872 | A | 1/1996 | Hulett | |
| 5,662,060 | A * | 9/1997 | Lemke | B63B 59/02 114/343 |
| 6,308,653 | B1 | 10/2001 | Geraci | |
| 7,093,558 | B1 * | 8/2006 | Mandanici | B63B 17/02 114/361 |
| 7,146,926 | B1 | 12/2006 | Yang | |
| 7,555,994 | B1 | 7/2009 | Arnall | |
| 9,027,499 | B1 | 5/2015 | Clarke | |
| 9,120,539 | B1 | 9/2015 | Binder | |
| 11,377,173 | B1 * | 7/2022 | Stanton | B63B 17/02 |
| 2003/0234036 | A1 | 12/2003 | Brower et al. | |
| 2010/0037811 | A1 | 2/2010 | Grant | |
| 2014/0026803 | A1 | 1/2014 | Musacchio | |
| 2014/0102350 | A1 | 4/2014 | Marcrum | |
| 2020/0108896 | A1 | 4/2020 | Parniske | |
| 2020/0324860 | A1 | 10/2020 | Popa et al. | |

* cited by examiner

*Primary Examiner* — Lars A Olson
(74) *Attorney, Agent, or Firm* — NIXON & VANDERHYE P.C.

(57) ABSTRACT

A boat cover system includes a receptacle and a telescoping tent pole secured in the receptacle. The tent pole may include an outer tube selectively securable in the receptacle, an inner tube slidably mounted within the outer tube, and a linear actuator coupled with the inner tube and configured to displace the inner tube relative to the outer tube. With a boat cover positioned over the telescoping tent pole, the telescoping tent pole is displaceable between a retracted position and an extended position by the linear actuator such that the telescoping tent pole is configured to tension the boat cover in the extended position and to ease the tension in the retracted position.

17 Claims, 12 Drawing Sheets

REMOTE ACTUATED TENT POLE

CROSS-REFERENCES TO RELATED APPLICATIONS

This application claims the benefit of U.S. Provisional Patent Application No. 63/249,184, filed Sep. 28, 2021, the entire content of which is herein incorporated by reference.

STATEMENT REGARDING FEDERALLY SPONSORED RESEARCH OR DEVELOPMENT (NOT APPLICABLE)

BACKGROUND

The invention relates to a telescoping tent pole and, more particularly, to a remote actuated telescoping tent pole that facilitates installation and removal of a boat cover.

Boat covers are used routinely to prevent damage to boat components when not in use. Existing boat cover systems provide tent poles or the like to add cover tension and prevent water and debris from pooling in low spots. With the tent poles in place, however, boat owners sometimes have to crawl into the boat to loosen one pole to relieve cover tension required to unclip or unsnap the cover. Additionally, with tent poles in place, it can be difficult to secure the last few snaps or clips of the cover when installing the cover.

SUMMARY

It would thus be desirable to improve the level of ease and user-friendliness to boaters looking to support boat covers and prevent water and debris from pooling. The remote actuated tent pole of the described embodiments eliminates the need to crawl into the boat to loosen the first pole to relieve cover tension required to unclip or unsnap the cover. With a switch wired at a desired location at one end of the boat or access through a smart phone app, boaters can automatically raise the tent pole of the described embodiments to add tension in the boat cover. As described in more detail below, the tent pole receptacle can be integrated in the deck floor and capped smooth when not in use. Alternatively, the tent pole receptacle may form part of a base unit including a battery housing.

In an exemplary embodiment, a boat cover system includes a receptacle and a telescoping tent pole with an outer tube selectively securable in the receptacle, an inner tube slidably mounted within the outer tube, and a linear actuator coupled with the inner tube and configured to displace the inner tube relative to the outer tube. A boat cover is positioned over the telescoping tent pole. The telescoping tent pole is displaceable between a retracted position and an extended position by the linear actuator, and the telescoping tent pole is configured to tension the boat cover in the extended position and to ease the tension in the retracted position.

The receptacle may be recessed in the boat deck, and the receptacle may include a flush cap.

The linear actuator may be motorized. The receptacle may include a power source, and the telescoping tent pole may include a plug connectable to the power source when the telescoping tent pole is secured in the receptacle. The telescoping tent pole may include a wireless transmission integrated circuit or network.

The telescoping tent pole may include a first stop defining the extended position and a second stop defining the retracted position.

The boat cover may also include a base unit securable to a surface, where the receptacle may be formed in the base unit. The base unit may include a base plate in which the receptacle is formed, and a battery housing secured to the base plate. The battery housing may be water proof or water resistant. The base unit may include a switch and a control circuit, where the control circuit may be configured to power the linear actuator based on signals from the switch. The control circuit may include a wireless transmission integrated circuit or network.

In another exemplary embodiment, a boat cover system includes a receptacle, a power source, and a telescoping tent pole with an outer tube having a plug selectively securable in the receptacle and connectable to the power source, an inner tube slidably mounted within the outer tube, and a motorized linear actuator coupled with the inner tube and configured to displace the inner tube relative to the outer tube. A boat cover is positioned over the boat deck and the telescoping tent pole. The telescoping tent pole is displaceable between a retracted position and an extended position by the motorized linear actuator. The telescoping tent pole is configured to tension the boat cover in the extended position and to ease the tension in the retracted position.

The receptacle may include the power source. The boat cover system may include a battery housing, where the power source is disposed in the battery housing.

BRIEF DESCRIPTION OF THE DRAWINGS

These and other aspects and advantages will be described in detail with reference to the accompanying drawings, in which.

DETAILED DESCRIPTION

Figure 1:
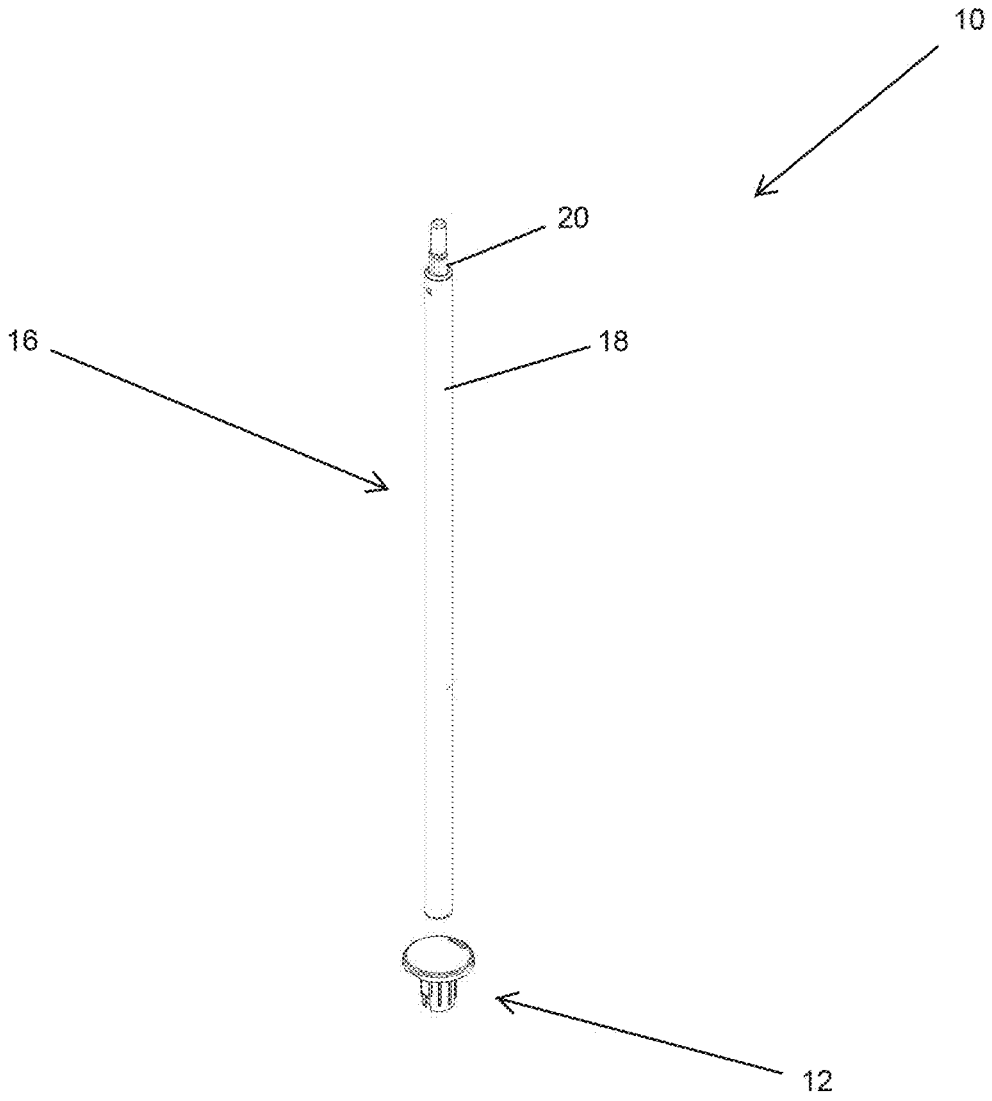
FIG. 1 shows the tent pole of the described embodiments in a retracted position.
Figure 2:
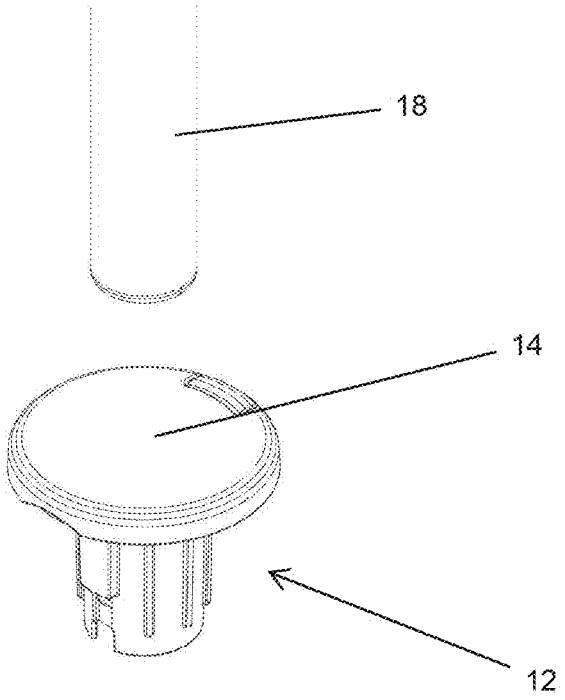
FIGS. 2 and 3 are close-up views of a receptacle in the boat deck.
Figure 3:
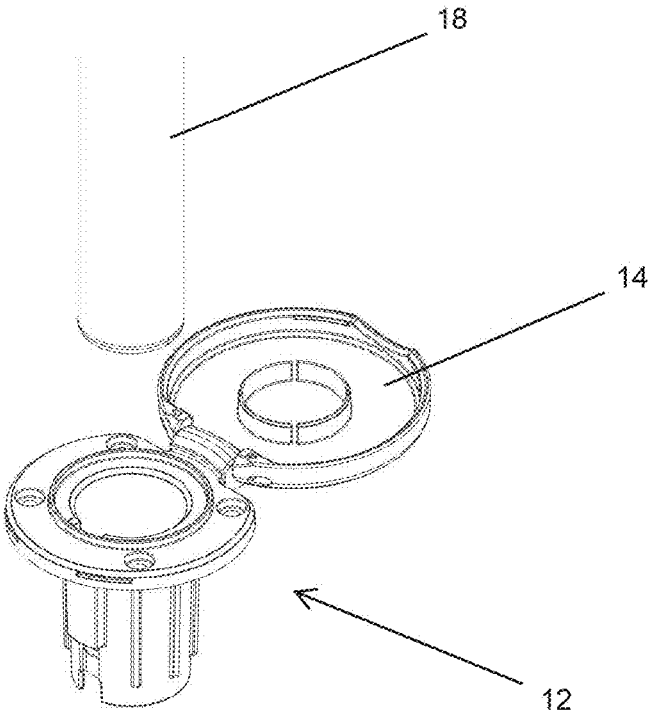

With reference to the drawings, in some embodiments, the boat cover system 10 includes a receptacle 12 in a boat deck. The receptacle 12 may be recessed in the boat deck and includes a flush cap 14. As such, with the cap 14 closed as shown in FIGS. 1 and 2, the receptacle 12 is flush with the deck floor.

A telescoping tent pole 16 includes an outer tube 18 securable in the receptacle 12 and an inner tube 20 slidably mounted within the outer tube 18. As discussed in more detail below, a linear actuator 22 is coupled with the inner tube 20 and is configured to displace the inner tube 20 relative to the outer tube 18.

Figure 5:
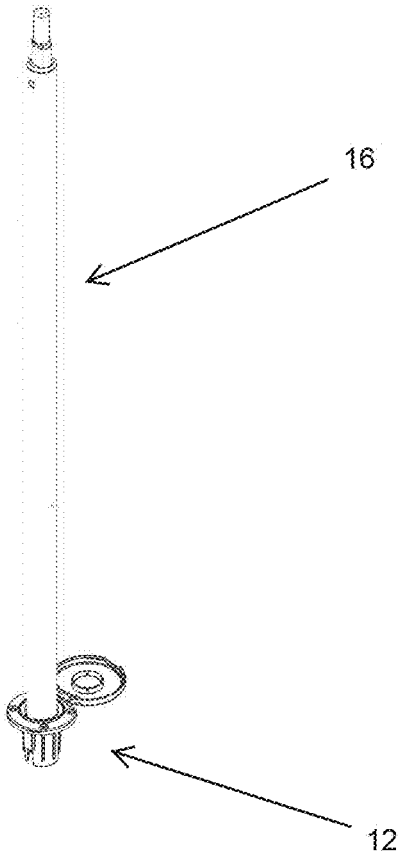
FIG. 5 shows the tent pole installed in the receptacle.
Figure 6:
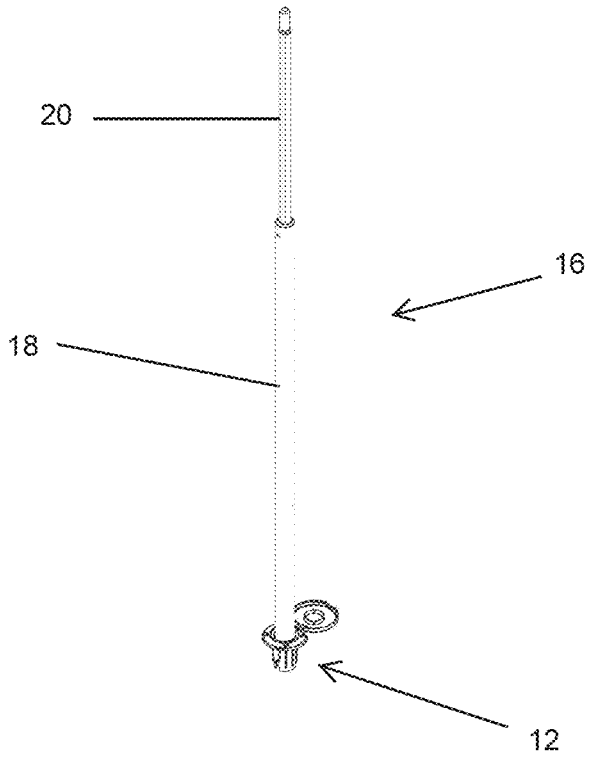
FIG. 6 shoes the tent pole in an extended position.
Figure 10:
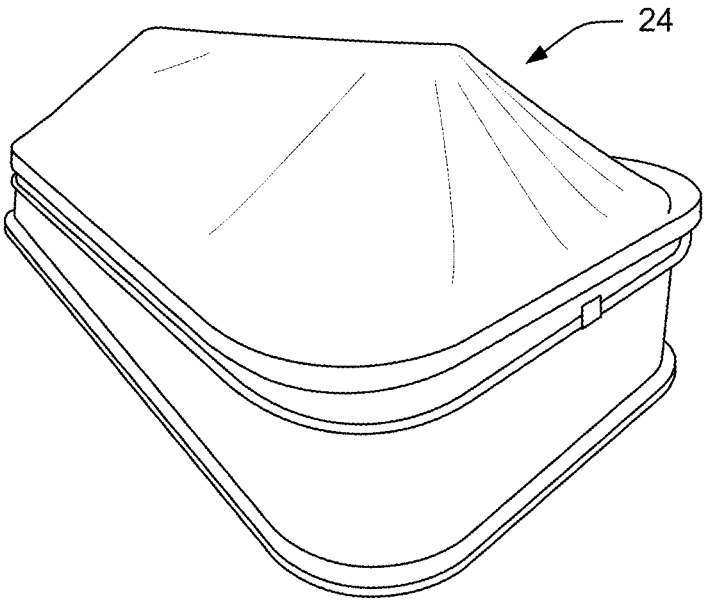
FIG. 10 shows the boat cover system with the tent pole in the retracted position.
Figure 11:
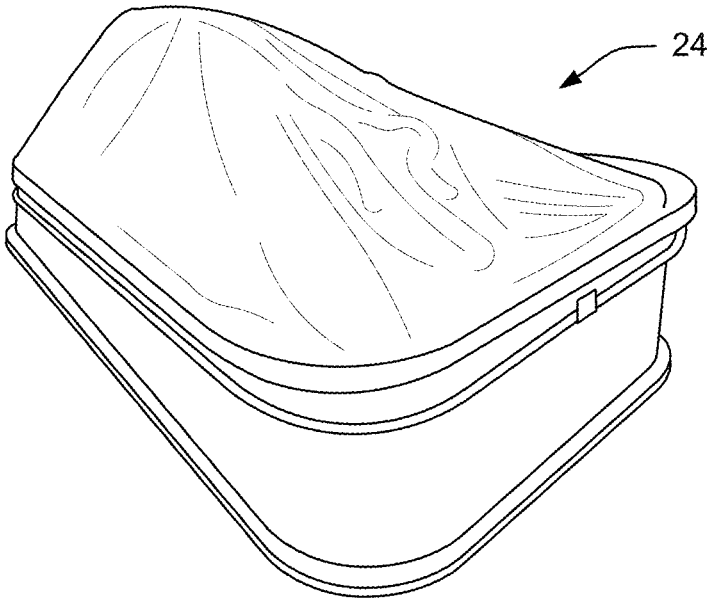
FIG. 11 shows the boat cover system with the tent pole in the extended position.

In use, with reference to FIGS. 10 and 11, a boat cover 24 is positioned over the telescoping tent pole 16. In some embodiments, a flexible member may be sewed into the boat cover 24 with a connector or the like for receiving the inner tube 20 of the telescoping tent pole 16. The telescoping tent pole 16 is displaceable between a retracted position as shown in FIGS. 1, 5 and 11 and an extended position as shown in FIGS. 6 and 10 by the linear actuator 22. As such, the telescoping tent pole 16 serves to tension the boat cover 24 in the extended position as shown in FIG. 10 and to ease the tension in the retracted position as shown in FIG. 11. With the tension eased, the operator can exit the boat without struggling to fasten the last clips or snaps, and once off the boat, the operator can extend the telescoping tent pole 16 to tension the boat cover 24.

Figure 4:
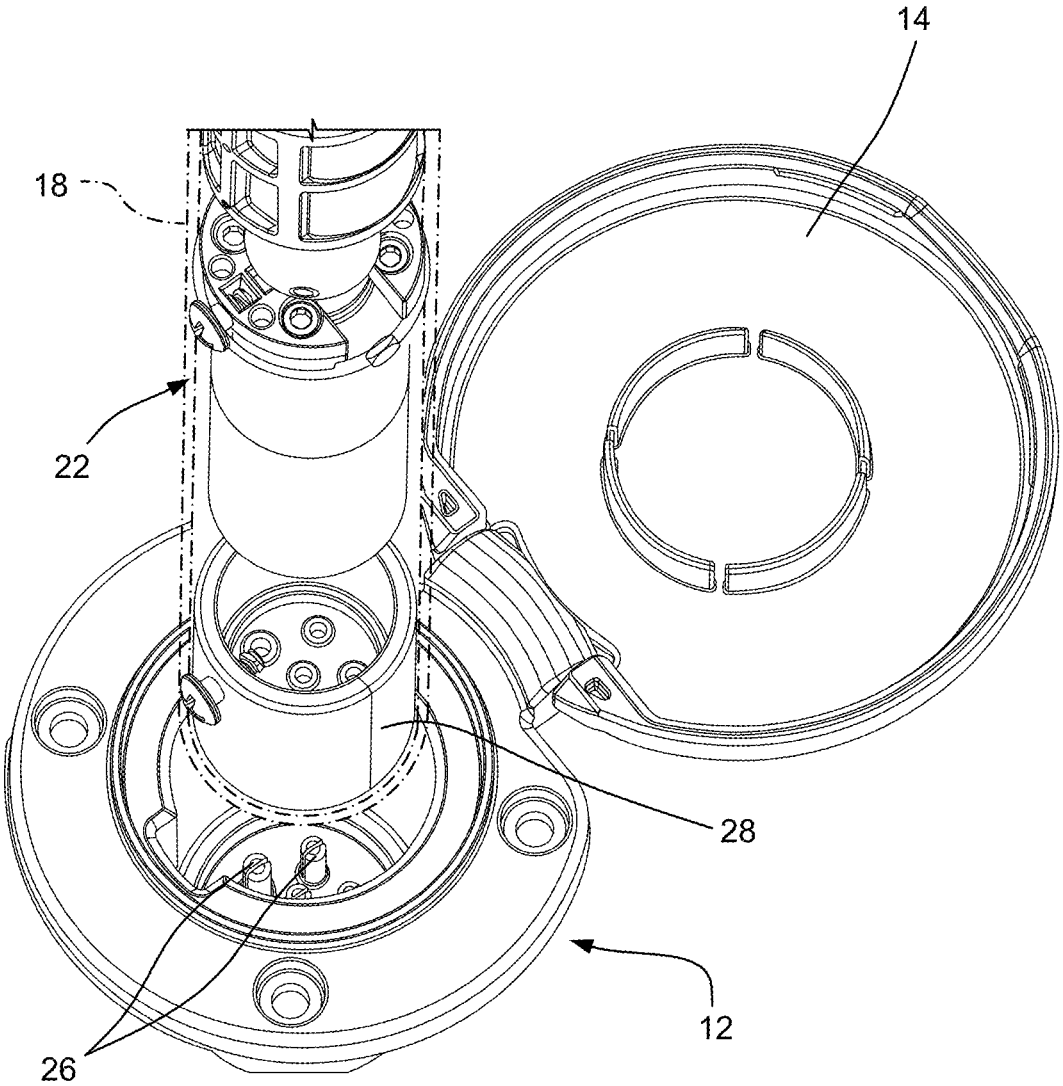
FIG. 4 shows components of an exemplary linear actuator.

In some embodiments, the linear actuator 22 is motorized. Any linear actuator may be suitable for extending and retracting the telescoping tent pole 16. In an exemplary construction, with reference to FIG. 4, the receptacle 12 may be provided with a power source. That is, the receptacle 12 may include contact pins 26 or the like that are electrically connected to a source of power (onboard battery or external current supply). As an alternative, the telescoping tent pole 16 may be provided with onboard batteries for battery power.

The telescoping tent pole 16 may be provided with a corresponding plug 28 connectable to the power source in the receptacle 12 when the telescoping tent pole 16 is secured in the receptacle 12. The contact pins 26 may be wired to a switch at a desired location at one end of the boat or may alternatively be accessed via a wireless transmission integrated circuit or network (e.g., Wi-Fi, Bluetooth, or the like). With this structure, the telescoping tent pole 16 can be extended and retracted remotely via an app on the user's phone or the like.

FIG. 5 shows the telescoping tent pole 16 positioned in the receptacle 12 and in the retracted position. FIG. 6 shows the telescoping tent pole 16 in the extended position.

Figure 7:
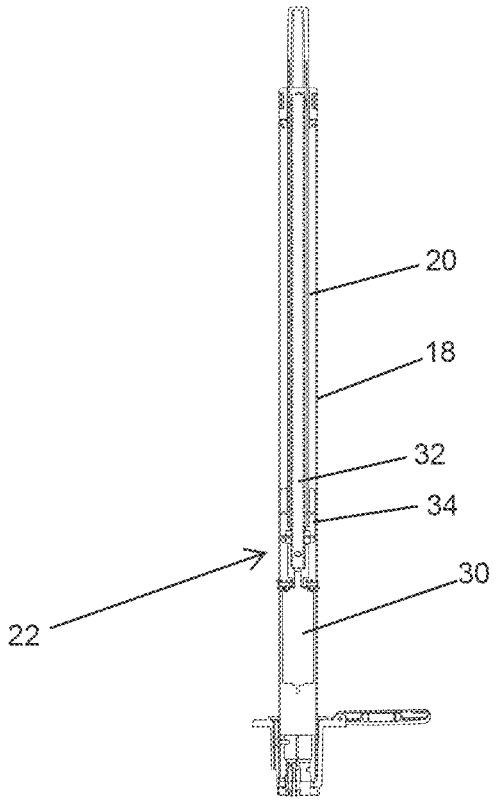
FIGS. 7-9 are sectional views showing details of the linear actuator.
Figure 8:
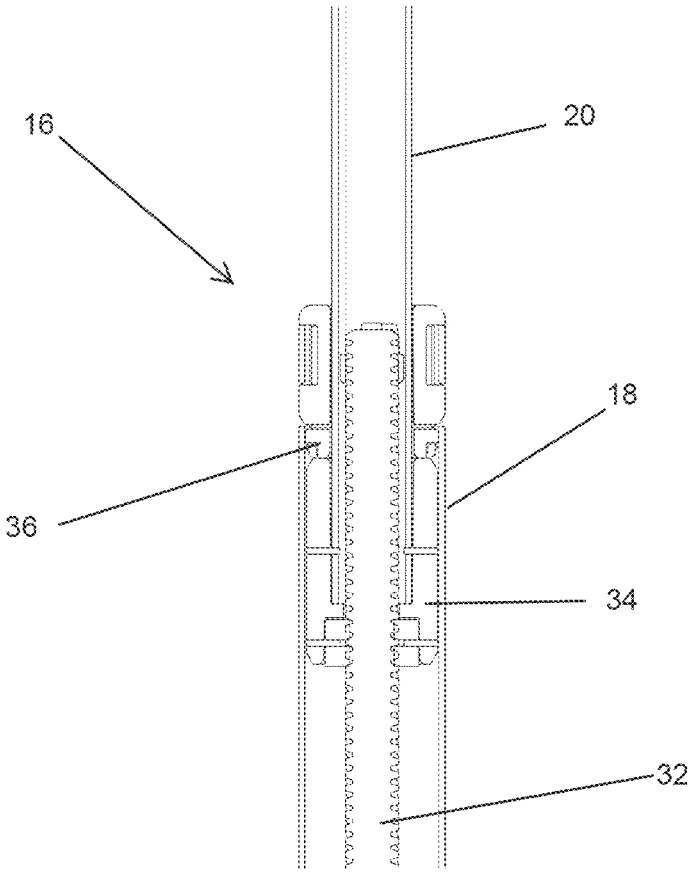
Figure 9:
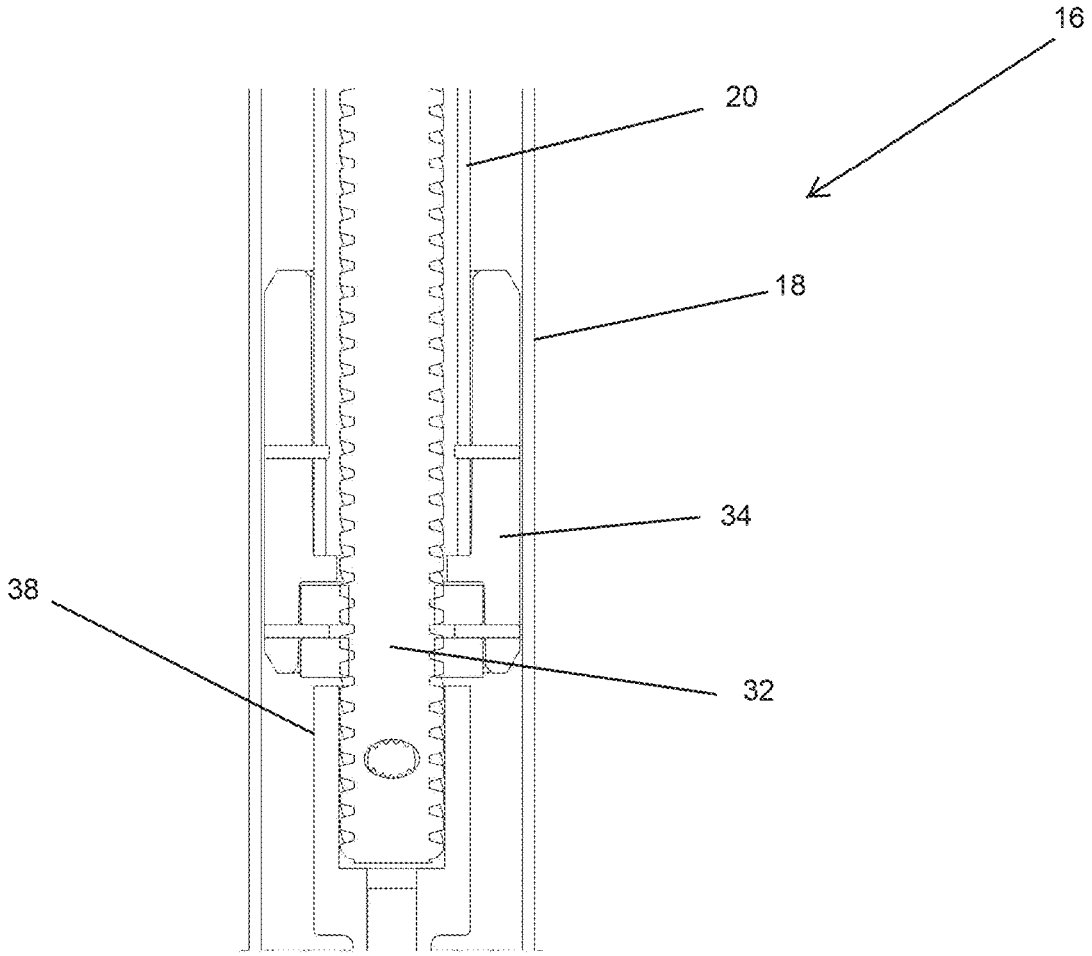

FIGS. 7-9 show an exemplary linear actuator for extending and retracting the inner tube 20 relative to the outer tube 18. The construction may be reversed such that the outer tube 18 extends and retracts relative to the inner tube 20. The exemplary linear actuator 22 includes a motor 30 connected to a drive screw 32. A carriage 34 is coupled with the drive screw 32 and is displaced up or down on the drive screw 32 depending on a rotation direction of the drive screw 32. The drive screw 32 and the carriage 34 are disposed within the outer tube 18. The inner tube 20 is connected to and displaceable with the carriage 34.

The telescoping tent pole 16 includes an upper stop 36 (FIG. 8) within the outer tube 18 that serves as an upper stop limit for the carriage 34 and defines the extended position of the telescoping tent pole 16. A lower stop 38 (FIG. 9) serves as a lower stop limit for the carriage 34 and defines the retracted position for the telescoping tent pole 16.

Figure 12:
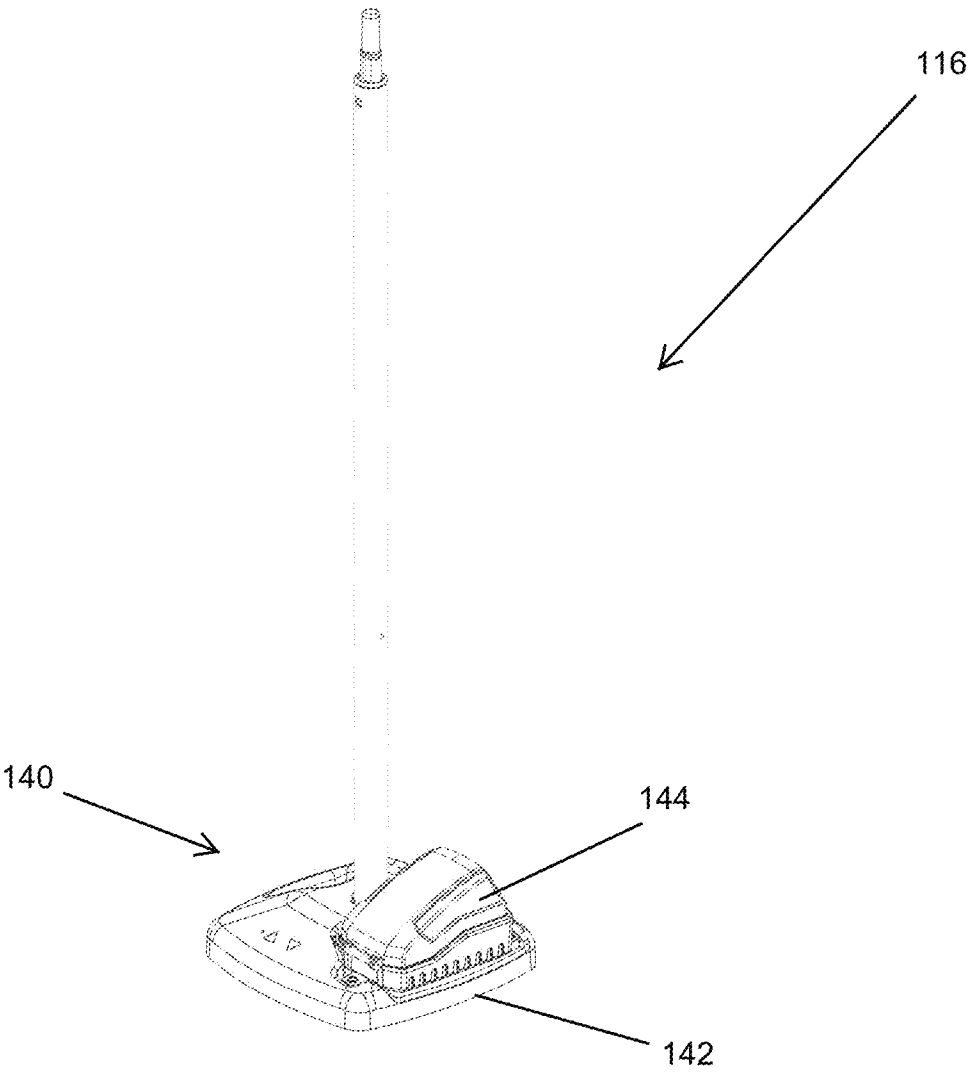
FIG. 12 shows a variation with an integrated battery housing.
Figure 13:
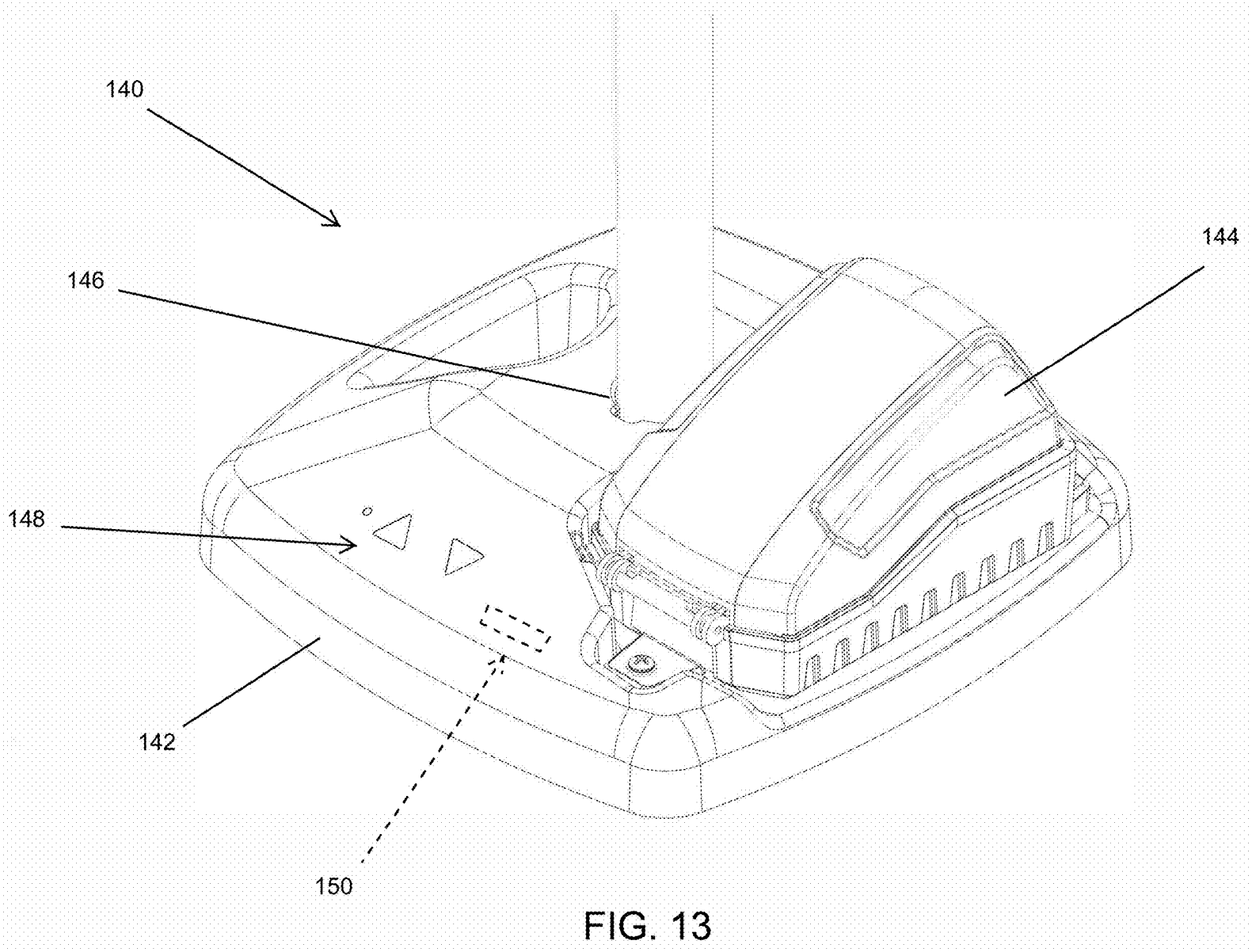
FIG. 13 is a close-up view of the base unit and battery housing.

FIGS. 12 and 13 show a variation of the telescoping tent pole 116 with an integrated battery housing and battery. Instead of mounting the tent pole into the recess in the boat deck, the modified telescoping tent pole 116 includes a base unit 140 that is securable directly to the boat deck or other surface. The base unit 140 includes a base plate 142, a battery housing 144 secured to the base plate 142, and a receptacle 146 in the base plate 142 for receiving the tent pole 116. The battery housing 144 is preferably water proof or water resistant and stores a battery for powering the linear actuator.

The base unit 140 may also be provided with a switch 148 in the form of up/down arrows or the like. Additionally, the base unit 140 may be provided with a control circuit 150 such as a wireless transmission integrated circuit or network (e.g., Wi-Fi, Bluetooth, or the like). The control circuit 150 powers the linear actuator based on input from the switch 148 and/or a remote device such as a smart phone, tablet or computer.

The boat cover system of the described embodiments eliminates the need to crawl into the boat to loosen a first pole to relieve cover tension required to unclip or unsnap the cover. Similarly, the system allows a boat operator to exit the boat without struggling to fasten the last clips or snaps on the boat cover. Once off the boat, the user can automatically raise the tent pole to provide the desired tension in the boat cover. The system also allows users to maintain a desired tension on the boat cover as the boat cover may stretch over time. As described, the system can be wired to a switch at a desired location at one end of the boat or can be accessed through a smart phone/computer app. The receptacle in the boat deck can be integrated into the deck floor and capped smooth when not in use. Alternatively, the receptacle may be integrated into a base unit with a battery housing. In most cases, only one telescoping tent pole is required. The tent pole is the same physical size as a standard tent pole and is stored in a similar manner.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A boat cover system comprising:

a receptacle comprising a contact surface electrically connectable to a power source;

a telescoping tent pole including a fixed tube selectively securable in the receptacle, a sliding tube slidably mounted relative to the fixed tube, and a linear actuator coupled with the sliding tube and configured to displace the sliding tube relative to the fixed tube, wherein the fixed tube comprises a plug connectable to the power source via the contact surface; and a boat cover positioned over the telescoping tent pole, wherein the telescoping tent pole is displaceable between a retracted position and an extended position by the linear actuator, and wherein the telescoping tent pole is configured to tension the boat cover in the extended position and to ease the tension in the retracted position.

2. A boat cover system according to claim 1, wherein the receptacle is recessed in a boat deck, and wherein the receptacle comprises a flush cap.

3. A boat cover system according to claim 1, wherein the linear actuator is motorized.

4. A boat cover system comprising:

a receptacle;

a telescoping tent pole including a fixed tube selectively securable in the receptacle, a sliding tube slidably mounted relative to the fixed tube, and a linear actuator coupled with the sliding tube and configured to displace the sliding tube relative to the fixed tube; and a boat cover positioned over the telescoping tent pole, wherein the telescoping tent pole is displaceable between a retracted position and an extended position by the linear actuator, and wherein the telescoping tent pole is configured to tension the boat cover in the extended position and to ease the tension in the retracted position, wherein the linear actuator is motorized, wherein the receptacle comprises a power source, and wherein the telescoping tent pole comprises a plug connectable to the power source when the telescoping tent pole is secured in the receptacle.

5. A boat cover system according to claim 3, wherein the telescoping tent pole comprises a wireless transmission integrated circuit or network.

6. A boat cover system according to claim 1, wherein the telescoping tent pole comprises a first stop defining the extended position and a second stop defining the retracted position.

7. A boat cover system according to claim 1, further comprising a base unit securable to a surface, wherein the receptacle is formed in the base unit.

8. A boat cover system according to claim 7, wherein the base unit comprises a base plate in which the receptacle is formed, and a battery housing secured to the base plate.

9. A boat cover system according to claim 8, wherein the battery housing is water proof or water resistant.

10. A boat cover system according to claim 8, wherein the base unit comprises a switch and a control circuit, the control circuit being configured to power the linear actuator based on signals from the switch.

11. A boat cover system according to claim 10, wherein the control circuit comprises a wireless transmission integrated circuit or network.

12. A boat cover system comprising:

a receptacle;

a power source;

a telescoping tent pole including an outer tube with a plug selectively securable in the receptacle and connectable to the power source, an inner tube slidably mounted within the outer tube, and a motorized linear actuator coupled with the inner tube and configured to displace the inner tube relative to the outer tube; and a boat cover positioned over a boat deck and the telescoping tent pole, wherein the telescoping tent pole is displaceable between a retracted position and an extended position by the motorized linear actuator, and wherein the telescoping tent pole is configured to tension the boat cover in the extended position and to ease the tension in the retracted position.

13. A boat cover system according to claim 12, wherein the telescoping tent pole comprises a wireless transmission integrated circuit or network.

14. A boat cover system according to claim 12, wherein the receptacle is recessed in a boat deck.

15. A boat cover system according to claim 12, wherein the receptacle comprises the power source.

16. A boat cover system according to claim 12, further comprising a battery housing, wherein the power source is disposed in the battery housing.

17. A boat cover system according to claim 16, further comprising a base unit including a base plate, the battery housing secured to the base plate, a switch, and a control circuit, wherein the receptacle is formed in the base plate.

* * * * *